US011286542B2

(12) United States Patent
Yoshida et al.

(10) Patent No.: US 11,286,542 B2
(45) Date of Patent: Mar. 29, 2022

(54) ALUMINUM ALLOY FOR DIE CASTING AND FUNCTIONAL COMPONENT USING THE SAME

(71) Applicants: AISIN KEIKINZOKU CO., LTD., Imizu (JP); AISIN AW CO., LTD., Anjo (JP)

(72) Inventors: Tomoo Yoshida, Imizu (JP); Satoshi Nishikawa, Imizu (JP); Michihiro Toyoda, Anjo (JP)

(73) Assignees: AISIN KEIKINZOKU CO., LTD.; AISIN AW CO., LTD.

( * ) Notice: Subject to any disclaimer, the term of this patent is extended or adjusted under 35 U.S.C. 154(b) by 0 days.

(21) Appl. No.: 16/823,805

(22) Filed: Mar. 19, 2020

(65) Prior Publication Data

US 2020/0216934 A1 Jul. 9, 2020

Related U.S. Application Data

(63) Continuation of application No. PCT/JP2018/034351, filed on Sep. 18, 2018.

(30) Foreign Application Priority Data

Sep. 20, 2017 (JP) ..... JP2017-180033

(51) Int. Cl.
*C22C 21/02* (2006.01)
*C22F 1/043* (2006.01)

(52) U.S. Cl.
CPC ..... *C22C 21/02* (2013.01); *C22F 1/043* (2013.01)

(58) Field of Classification Search
CPC ..... C22C 21/02; C22F 1/043
See application file for complete search history.

(56) References Cited

U.S. PATENT DOCUMENTS

2004/0170523 A1 9/2004 Koch
2009/0010799 A1* 1/2009 Souda ..... C22C 21/02 420/535
2016/0355908 A1 12/2016 Yoshida et al.

FOREIGN PATENT DOCUMENTS

JP 4970709 B2 7/2012
JP 2016-102246 A 6/2016
JP 2016102246 A * 6/2016
WO WO-2015-151369 A1 10/2015

OTHER PUBLICATIONS

Eiken, Janin, et al. "Impact of P and Sr on solidification sequence and morphology of hypoeutectic Al—Si alloys: Combined thermodynamic computation and phase-field simulation." Acta Materialia 98 (2015): 152-163. (Year: 2015).*
JP-2016102246-A english translation (Year: 2016).*
JP2016102246A claims (Year: 2016).*

* cited by examiner

*Primary Examiner* — Sally A Merkling
*Assistant Examiner* — Ricardo D Morales
(74) *Attorney, Agent, or Firm* — Harness, Dickey & Pierce, P.L.C.

(57) ABSTRACT

Intended is to provide an aluminum alloy for die casting having a high strength as well as capable of achieving excellent elongation properties and a functional component using the aluminum alloy. The aluminum alloy comprises, by mass, 6 to 9% of Si, 0.30 to 0.60% of Mg, 0.30 to 0.60% of Cu, 0.25% or less of Fe, 0.60% or less of Mn, 0.2% or less of Ti, 200 ppm or less of Sr, and 5 ppm or less of P, with the balance being Al and inevitable impurities, and wherein Sr(ppm)−4.2×P(ppm)≥50.

4 Claims, 3 Drawing Sheets

| | CHEMICAL COMPONENTS | | | | | | | | | | | | | (A)Sr-4.2×P (A)≧50 | TEMPER |
|---|---|---|---|---|---|---|---|---|---|---|---|---|---|---|---|
| | Cu (%) | Si (%) | Fe (%) | Zn (%) | Mg (%) | Mn (%) | Ni (%) | Sn (%) | Ti (%) | Cr (%) | Sr (ppm) | P (ppm) | Al | | |
| EXAMPLE 1 | 0.51 | 7.9 | 0.12 | 0.01 | 0.34 | 0.52 | 0.00 | 0.00 | 0.11 | 0.00 | 120 | 5 | BAL-ANCE | 99 | T5 |
| EXAMPLE 2 | 0.47 | 8.1 | 0.12 | 0.02 | 0.34 | 0.34 | 0.01 | 0.00 | 0.08 | 0.00 | 144 | 5 | BAL-ANCE | 123 | T5 |
| EXAMPLE 3 | 0.48 | 8.2 | 0.12 | 0.00 | 0.34 | 0.35 | 0.00 | 0.00 | 0.10 | 0.00 | 153 | 5 | BAL-ANCE | 132 | T5 |
| EXAMPLE 4 | 0.48 | 8.3 | 0.17 | 0.00 | 0.35 | 0.37 | 0.01 | 0.00 | 0.09 | 0.00 | 151 | 5 | BAL-ANCE | 130 | T5 |
| EXAMPLE 5 | 0.46 | 7.9 | 0.10 | 0.01 | 0.34 | 0.28 | 0.00 | 0.00 | 0.10 | 0.00 | 89 | 5 | BAL-ANCE | 68 | T5 |
| EXAMPLE 6 | 0.42 | 8.4 | 0.18 | 0.01 | 0.41 | 0.33 | 0.01 | 0.00 | 0.11 | 0.00 | 93 | 5 | BAL-ANCE | 72 | T5 |
| COMPARATIVE EXAMPLE 1 | 0.29 | 8.0 | 0.17 | 0.00 | 0.71 | 0.22 | 0.01 | 0.00 | 0.11 | 0.00 | 100 | 12 | BAL-ANCE | 50 | T5 |
| COMPARATIVE EXAMPLE 2 | 0.80 | 8.0 | 0.17 | 0.00 | 0.69 | 0.22 | 0.01 | 0.00 | 0.11 | 0.00 | 80 | 14 | BAL-ANCE | 21 | T5 |
| COMPARATIVE EXAMPLE 3 | 0.50 | 7.9 | 0.11 | 0.00 | 0.51 | 0.00 | 0.01 | 0.00 | 0.12 | 0.00 | 70 | 4 | BAL-ANCE | 53 | T5 |
| COMPARATIVE EXAMPLE 4 | 0.51 | 8.0 | 0.23 | 0.00 | 0.51 | 0.00 | 0.01 | 0.00 | 0.11 | 0.00 | 60 | 10 | BAL-ANCE | 18 | T5 |
| COMPARATIVE EXAMPLE 5 | 0.51 | 8.0 | 0.11 | 0.00 | 0.53 | 0.56 | 0.01 | 0.00 | 0.11 | 0.00 | 80 | 12 | BAL-ANCE | 30 | T5 |
| COMPARATIVE EXAMPLE 6 | 0.52 | 8.0 | 0.23 | 0.00 | 0.53 | 0.55 | 0.01 | 0.00 | 0.11 | 0.00 | 70 | 7 | BAL-ANCE | 41 | T5 |
| COMPARATIVE EXAMPLE 7 | 0.61 | 8.0 | 0.17 | 0.00 | 0.58 | 0.22 | 0.01 | 0.00 | 0.11 | 0.00 | 80 | 10 | BAL-ANCE | 38 | T5 |
| COMPARATIVE EXAMPLE 8 | 0.52 | 8.8 | 0.18 | 0.00 | 0.50 | 0.20 | 0.01 | 0.00 | 0.10 | 0.00 | 60 | 11 | BAL-ANCE | 14 | T5 |
| COMPARATIVE EXAMPLE 9 | 0.52 | 7.3 | 0.18 | 0.00 | 0.45 | 0.21 | 0.01 | 0.00 | 0.10 | 0.00 | 70 | 12 | BAL-ANCE | 20 | T5 |

FIG. 1A

| | CHEMICAL COMPONENTS | | | | | | | | | | | | | (A)Sr-4.2×P | TEMPER |
|---|---|---|---|---|---|---|---|---|---|---|---|---|---|---|---|
| | Cu (%) | Si (%) | Fe (%) | Zn (%) | Mg (%) | Mn (%) | Ni (%) | Sn (%) | Ti (%) | Cr (%) | Sr (ppm) | P (ppm) | Al | (A)≧50 | |
| EXAMPLE 1 | 0.51 | 7.9 | 0.12 | 0.01 | 0.34 | 0.52 | 0.00 | 0.00 | 0.11 | 0.00 | 120 | 5 | BAL-ANCE | 99 | T5 |
| EXAMPLE 2 | 0.47 | 8.1 | 0.12 | 0.02 | 0.34 | 0.34 | 0.01 | 0.00 | 0.08 | 0.00 | 144 | 5 | BAL-ANCE | 123 | T5 |
| EXAMPLE 3 | 0.48 | 8.2 | 0.12 | 0.00 | 0.34 | 0.35 | 0.00 | 0.00 | 0.10 | 0.00 | 153 | 5 | BAL-ANCE | 132 | T5 |
| EXAMPLE 4 | 0.48 | 8.3 | 0.17 | 0.00 | 0.35 | 0.37 | 0.01 | 0.00 | 0.09 | 0.00 | 151 | 5 | BAL-ANCE | 130 | T5 |
| EXAMPLE 5 | 0.46 | 7.9 | 0.10 | 0.01 | 0.34 | 0.28 | 0.00 | 0.00 | 0.10 | 0.00 | 89 | 5 | BAL-ANCE | 68 | T5 |
| EXAMPLE 6 | 0.42 | 8.4 | 0.18 | 0.01 | 0.41 | 0.33 | 0.01 | 0.00 | 0.11 | 0.00 | 93 | 5 | BAL-ANCE | 72 | T5 |
| COMPARATIVE EXAMPLE 1 | 0.29 | 8.0 | 0.17 | 0.00 | 0.71 | 0.22 | 0.01 | 0.00 | 0.11 | 0.00 | 100 | 12 | BAL-ANCE | 50 | T5 |
| COMPARATIVE EXAMPLE 2 | 0.80 | 8.0 | 0.17 | 0.00 | 0.69 | 0.22 | 0.01 | 0.00 | 0.11 | 0.00 | 80 | 14 | BAL-ANCE | 21 | T5 |
| COMPARATIVE EXAMPLE 3 | 0.50 | 7.9 | 0.11 | 0.00 | 0.51 | 0.00 | 0.01 | 0.00 | 0.12 | 0.00 | 70 | 4 | BAL-ANCE | 53 | T5 |
| COMPARATIVE EXAMPLE 4 | 0.51 | 8.0 | 0.23 | 0.00 | 0.51 | 0.00 | 0.01 | 0.00 | 0.11 | 0.00 | 60 | 10 | BAL-ANCE | 18 | T5 |
| COMPARATIVE EXAMPLE 5 | 0.51 | 8.0 | 0.11 | 0.00 | 0.53 | 0.56 | 0.01 | 0.00 | 0.11 | 0.00 | 80 | 12 | BAL-ANCE | 30 | T5 |
| COMPARATIVE EXAMPLE 6 | 0.52 | 8.0 | 0.23 | 0.00 | 0.53 | 0.55 | 0.01 | 0.00 | 0.11 | 0.00 | 70 | 7 | BAL-ANCE | 41 | T5 |
| COMPARATIVE EXAMPLE 7 | 0.61 | 8.0 | 0.17 | 0.00 | 0.58 | 0.22 | 0.01 | 0.00 | 0.11 | 0.00 | 80 | 10 | BAL-ANCE | 38 | T5 |
| COMPARATIVE EXAMPLE 8 | 0.52 | 8.8 | 0.18 | 0.00 | 0.50 | 0.20 | 0.01 | 0.00 | 0.10 | 0.00 | 60 | 11 | BAL-ANCE | 14 | T5 |
| COMPARATIVE EXAMPLE 9 | 0.52 | 7.3 | 0.18 | 0.00 | 0.45 | 0.21 | 0.01 | 0.00 | 0.10 | 0.00 | 70 | 12 | BAL-ANCE | 20 | T5 |

FIG. 1B

| | CHEMICAL COMPONENTS | | | | | | | | | | | | | (A)Sr-4.2×P | TEMPER |
|---|---|---|---|---|---|---|---|---|---|---|---|---|---|---|---|
| | Cu (%) | Si (%) | Fe (%) | Zn (%) | Mg (%) | Mn (%) | Ni (%) | Sn (%) | Ti (%) | Cr (%) | Sr (ppm) | P (ppm) | Al | (A)≧50 | |
| COMPARATIVE EXAMPLE 10 | 0.83 | 8.7 | 0.18 | 0.00 | 0.74 | 0.19 | 0.01 | 0.00 | 0.10 | 0.00 | 80 | 14 | BAL-ANCE | 21 | T5 |
| COMPARATIVE EXAMPLE 11 | 0.51 | 8.6 | 0.22 | 0.00 | 0.53 | 0.49 | 0.01 | 0.00 | 0.10 | 0.00 | 60 | 21 | BAL-ANCE | -28 | T5 |
| COMPARATIVE EXAMPLE 12 | 0.00 | 6.7 | 0.09 | 0.01 | 0.41 | 0.01 | 0.00 | 0.00 | 0.11 | 0.00 | 0 | 10 | BAL-ANCE | -42 | T5 |
| COMPARATIVE EXAMPLE 13 | 0.06 | 6.1 | 0.48 | 0.01 | 0.44 | 0.58 | 0.00 | 0.00 | 0.00 | 0.00 | 0 | 7 | BAL-ANCE | -29 | T5 |
| COMPARATIVE EXAMPLE 14 | 0.79 | 7.4 | 0.08 | 0.01 | 0.49 | 0.41 | 0.00 | 0.00 | 0.12 | 0.00 | 60 | 8 | BAL-ANCE | 26 | T6 |
| COMPARATIVE EXAMPLE 15 | 0.79 | 7.4 | 0.08 | 0.00 | 0.49 | 0.41 | 0.00 | 0.00 | 0.12 | 0.00 | 70 | 6 | BAL-ANCE | 45 | T5 |
| COMPARATIVE EXAMPLE 16 | 0.00 | 6.7 | 0.09 | 0.01 | 0.41 | 0.01 | 0.00 | 0.00 | 0.11 | 0.00 | 60 | 5 | BAL-ANCE | 39 | T6 |
| COMPARATIVE EXAMPLE 17 | 0.50 | 7.7 | 0.11 | 0.01 | 0.31 | 0.00 | 0.00 | 0.00 | 0.11 | 0.00 | 70 | 28 | BAL-ANCE | -48 | T6 |
| COMPARATIVE EXAMPLE 18 | 2.52 | 11.3 | 0.65 | 0.01 | 0.29 | 0.00 | 0.00 | 0.00 | 0.09 | 0.00 | 70 | 30 | BAL-ANCE | -56 | F |
| COMPARATIVE EXAMPLE 19 | 2.52 | 11.3 | 0.65 | 0.01 | 0.29 | 0.00 | 0.00 | 0.00 | 0.09 | 0.00 | 60 | 28 | BAL-ANCE | -58 | T6 |
| COMPARATIVE EXAMPLE 20 | 2.52 | 11.3 | 0.65 | 0.01 | 0.29 | 0.00 | 0.00 | 0.00 | 0.09 | 0.00 | 80 | 30 | BAL-ANCE | -46 | T5 |
| COMPARATIVE EXAMPLE 21 | 0.96 | 7.6 | 0.11 | 0.01 | 0.52 | 0.43 | 0.01 | 0.00 | 0.11 | 0.00 | 50 | 5 | BAL-ANCE | 29 | T5 |
| COMPARATIVE EXAMPLE 22 | 3.20 | 9.5 | 0.12 | 0.01 | 0.31 | 1.05 | 0.00 | 0.00 | 0.02 | 0.00 | 60 | 4 | BAL-ANCE | 43 | T6 |
| COMPARATIVE EXAMPLE 23 | 3.20 | 9.5 | 0.12 | 0.01 | 0.31 | 1.05 | 0.00 | 0.00 | 0.02 | 0.00 | 60 | 5 | BAL-ANCE | 39 | T5 |
| COMPARATIVE EXAMPLE 24 | 2.60 | 7.9 | 0.12 | 0.01 | 0.29 | 1.20 | 0.00 | 0.00 | 0.03 | 0.00 | 60 | 5 | BAL-ANCE | 39 | T6 |

FIG. 2

| | MECHANICAL PROPERTIES | | | | | | APPEAR-ANCE | COMPREHENSIVE JUDGEMENT |
|---|---|---|---|---|---|---|---|---|
| | TENSILE STRENGTH (MPa) 260or more | | PROOF STRENGTH (MPa) 150 or more | | ELONGATION (%) 10 or more | | | |
| EXAMPLE 1 | 295 | ○ | 200 | ○ | 11 | ○ | | ○ |
| EXAMPLE 2 | 310 | ○ | 209 | ○ | 10 | ○ | | ○ |
| EXAMPLE 3 | 317 | ○ | 207 | ○ | 11 | ○ | | ○ |
| EXAMPLE 4 | 301 | ○ | 199 | ○ | 10 | ○ | | ○ |
| EXAMPLE 5 | 304 | ○ | 192 | ○ | 11 | ○ | | ○ |
| EXAMPLE 6 | 308 | ○ | 211 | ○ | 10 | ○ | | ○ |
| COMPARATIVE EXAMPLE 1 | 269 | ○ | 205 | ○ | 7 | × | | × |
| COMPARATIVE EXAMPLE 2 | 289 | ○ | 214 | ○ | 6 | × | | × |
| COMPARATIVE EXAMPLE 3 | 289 | ○ | 211 | ○ | 11 | ○ | SEIZURE | × |
| COMPARATIVE EXAMPLE 4 | 268 | ○ | 204 | ○ | 6 | × | SEIZURE | × |
| COMPARATIVE EXAMPLE 5 | 289 | ○ | 218 | ○ | 6 | × | | × |
| COMPARATIVE EXAMPLE 6 | 283 | ○ | 214 | ○ | 6 | × | | × |
| COMPARATIVE EXAMPLE 7 | 288 | ○ | 204 | ○ | 9 | × | | × |
| COMPARATIVE EXAMPLE 8 | 257 | × | 200 | ○ | 6 | × | | × |
| COMPARATIVE EXAMPLE 9 | 290 | ○ | 210 | ○ | 8 | × | | × |
| COMPARATIVE EXAMPLE 10 | 265 | ○ | 217 | ○ | 6 | × | SEIZURE | × |
| COMPARATIVE EXAMPLE 11 | 256 | × | 211 | ○ | 5 | × | | × |
| COMPARATIVE EXAMPLE 12 | 235 | × | 147 | × | 15 | ○ | SEIZURE | × |
| COMPARATIVE EXAMPLE 13 | 242 | × | 185 | ○ | 7 | × | | × |
| COMPARATIVE EXAMPLE 14 | 357 | ○ | 255 | ○ | 7 | × | | × |
| COMPARATIVE EXAMPLE 15 | 287 | ○ | 210 | ○ | 8 | × | | × |
| COMPARATIVE EXAMPLE 16 | 320 | ○ | 280 | ○ | 11 | ○ | SEIZURE | × |
| COMPARATIVE EXAMPLE 17 | 341 | ○ | 239 | ○ | 12 | ○ | SEIZURE | × |
| COMPARATIVE EXAMPLE 18 | 295 | ○ | 185 | ○ | 2 | × | SEIZURE | × |
| COMPARATIVE EXAMPLE 19 | 353 | ○ | 297 | ○ | 2 | × | SEIZURE | × |
| COMPARATIVE EXAMPLE 20 | 269 | ○ | 220 | ○ | 2 | × | SEIZURE | × |
| COMPARATIVE EXAMPLE 21 | 295 | ○ | 201 | ○ | 6 | × | | × |
| COMPARATIVE EXAMPLE 22 | 349 | ○ | 296 | ○ | 2 | × | | × |
| COMPARATIVE EXAMPLE 23 | 283 | ○ | 198 | ○ | 2 | × | | × |
| COMPARATIVE EXAMPLE 24 | 366 | ○ | 322 | ○ | 3 | × | | × |

ALUMINUM ALLOY FOR DIE CASTING AND FUNCTIONAL COMPONENT USING THE SAME

CROSS REFERENCE TO RELATED APPLICATION

This application is a continuation of International Patent Application No. PCT/JP2018/034351, having an international filing date of Sep. 18, 2018, which designated the United States, the entirety of which is incorporated herein by reference. Japanese Patent Application No. 2017-180033 filed on Sep. 20, 2017 is also incorporated herein by reference in its entirety.

BACKGROUND ART

The present disclosure relates to an aluminum alloy for die casting, particularly relates to an aluminum alloy having a high tensile strength and excellent elongation properties and a functional component using the aluminum alloy.

Die casting using an aluminum alloy is a casting process in which a molten aluminum alloy is injection-molded in a mold at high speed and high pressure.

Because of its short shot cycle and high productivity, such die casting is employed for producing components in many industrial fields, such as automotive components and mechanical components.

Die casting requires flowability upon casting, and thus Al—Si based alloys have been used.

Aluminum alloys such as JIS ADC12, for example, are commonly used, but such alloys problematically have a low elongation.

Particularly, for functional components required to have a high strength, a heat treatment such as a thermal refining T5 is applied after die casting. However, coarse plate-like eutectic Si appears in the metal structure, or iron-based impurities contained in the aluminum alloy become a coarse needle-like structure. A fracture mode starting from the eutectic Si and/or needle-like structure lowers the elongation, as a result, it has been difficult to apply the alloy to functional components.

JP-B-4970709 discloses a technique to improve elongation properties by adding 0.08 to 0.25% by mass of molybdenum, but the strength was insufficient for application to functional components.

The present inventors thus have suggested in advance an aluminum alloy for die casting having a high strength and improved ductility (elongation) produced by adding Sr or Na (JP-A-2016-102246).

The aluminum alloy disclosed in JP-A-2016-102246 can provide a high strength and excellent elongation properties, which are required from functional components, by means of a thermal refining T6 treatment. However, there is room for further improvements in order to achieve a high strength and a high elongation by means of a thermal refining T5 treatment, which is more cost-efficient than the T6 treatment.

BRIEF DESCRIPTION OF THE DRAWINGS

FIGS. 1A and 1B illustrate the chemical composition of aluminum alloys used for evaluation.

FIG. 2 illustrates evaluation results.

DESCRIPTION OF EMBODIMENTS

The following disclosure provides many different embodiments, or examples, for implementing different features of the provided subject matter. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Further, when a first element is described as being "connected" or "coupled" to a second element, such description includes embodiments in which the first and second elements are directly connected or coupled to each other, and also includes embodiments in which the first and second elements are indirectly connected or coupled to each other with one or more other intervening elements in between.

It is an object of the disclosure to provide an aluminum alloy for die casting having a high strength as well as capable of achieving excellent elongation properties, and a functional component using the aluminum alloy.

In accordance with one of some embodiments, there is provided an aluminum alloy for die casting comprising, by mass: 6 to 9% of Si, 0.30 to 0.60% of Mg, 0.30 to 0.60% of Cu, 0.25% or less of Fe, 0.60% or less of Mn, 0.2% or less of Ti, 200 ppm or less of Sr, and 5 ppm or less of P, with the balance being Al and inevitable impurities, wherein $Sr(ppm)-4.2\times P(ppm)\geq 50$.

Here, the content of Sr in the range of 50 to 200 ppm is preferable, and the content of Fe in the range of 0.08 to 0.25% and the content of Mn in the range of 0.20 to 0.60% are preferable.

In accordance with one of some embodiments, there is provided a functional component having a tensile strength of 260 MPa or more and an elongation of 10% or more, provided by a thermal refining T5 treatment after die casting using the aluminum alloy for die casting according to any of claims 1 to 3.

In this specification, the functional component refers to a component required to have a tensile strength of 260 MPa or more and an elongation (ductility) of 10% or more.

For example, in the automobile field, examples include high-strength components required to have durability such as transmission components and engine components.

The thermal refining T5 treatment refers to an artificial aging treatment at a predetermined temperature after die casting, for example, a heat treatment at 160 to 220° C. for 2 to 12 hours.

The thermal refining T6 treatment refers to an artificial aging treatment after a solution treatment.

Thus, the T5 treatment, which requires no solution treatment step, is more cost-efficient accordingly in comparison with the T6 treatment and can prevent defects in association with a solution treatment from occurring.

Subsequently, the composition of the alloy will be described.

Si

The Si component immensely affects the flowability upon casting, and the content thereof is required to be 6% or more.

The elongation is lowered if Si forms coarse crystallized materials in an alloy structure, and thus the content thereof is preferably 9% or less.

Mg and Cu

When the Mg component and the Cu component are added in a predetermined amount, the strength is enhanced. However, when the amount added is excessive, the elongation is lowered. Thus, the content of Mg is set within the range of 0.30 to 0.60%, and the content of Cu is set within 0.30 to 0.60%.

Fe

The Fe component is a component likely to be mixed as an impurity in the step of production, casting, and the like of aluminum ingots. When coarse needle-like crystallized materials appear in the metal structure, the fracture of the structure starts from the crystallized materials. This fracture is responsible for lowering of the elongation.

Thus, the content of the Fe component is preferably 0.25% or less, and is set to 0.08 to 0.25% in the disclosure.

Sr and P

The Sr component makes the Si eutectic structure finer to thereby enhance the elongation properties.

However, when the P component is contained in the molten metal, P inhibits the grain refinement of the Si eutectic structure.

The present disclosure is thus suggested by suppressing the content of P to 5 ppm or less and adding the Sr component so as to satisfy $Sr-4.2\times P\geq 50$, wherein Sr is expressed in ppm by mass.

Note that the content of the Sr component is desirably set within the range of 50 to 200 ppm.

In order to suppress the P content in the molten metal to 5 ppm or less, a material containing no P is preferably used in furnace wall materials and the like of melting furnaces, and contamination with P is preferably suppressed by combining a rotary degasser, a flux treatment, and the like.

Mn

A small amount of the Mn component added has an effect of preventing seizure to a mold upon casting.

As the amount of Mn increases, the elongation is lowered. Thus, the content of the Mn component, if added, is preferably in the range of 0.20 to 0.60%.

Ti

The Ti component is effective for grain refinement, and the content thereof, if added, is preferably 0.2% or less.

Other components, for example, Zn, Ni, Sn, Cr, and the like are inevitable impurities, and the content thereof is preferably suppressed to 0.05% or less.

In the disclosure, a functional component having a high strength, that is, a tensile strength of 260 MPa or more, as well as having excellent ductility, that is, an elongation of 10% or more, can be obtained by using such an aluminum alloy and subjecting the alloy after die casting to an artificial aging treatment (T5 treatment) step.

In the aluminum alloy of the disclosure, high strength is achieved by addition of Mg and Cu components as well as elongation properties can be improved by suppression of the content of P and addition of a predetermined amount of Sr.

This enables the alloy to be applied even to functional components from which durability is required.

FIGS. 1A and 1B illustrate the results of analyzing the chemical components in melted aluminum alloys of Examples 1 to 6 and Comparative Examples 1 to 24 used for evaluation.

The values of Sr and P are expressed in ppm, and the values of the other components are expressed in % by mass.

These molten metals each were used to be die-cast into the aluminum alloys of a same shape, which were as-cast F materials. Specimens were cut out from the aluminum alloys in which the F materials were subjected to the T5 treatment or the T6 treatment and evaluated for mechanical characteristics in accordance with JIS Z 2241.

As the T5 treatment condition, an artificial aging treatment at 180° C. for four hours was performed.

As the T6 treatment condition, a solution treatment at 500° C., quenching by water-cooling, and then tempering at 180° C. for four hours were performed.

The specimen size was 180 mm×5 mm in width×5 mm in thickness, and the distance between gauge marks was 35 mm.

The evaluation results are illustrated in the table of FIG. 2.

In the disclosure, the evaluation was conducted with a target tensile strength set to 260 MPa or more, a target 0.2% proof strength set to 150 MPa or more, and a target elongation set to 10% or more.

In Examples 1 to 6, in which the concentration of the P component was 5 ppm, close to the upper limit, Sr was added such that the value of $(A)=Sr(ppm)-4.2\times P(ppm)$ reached 50 or more. Despite the concentration of P component is close to the upper limit, it was possible to achieve both the target tensile strength and the target elongation while the contents of the other chemical components were set within the target range.

In contrast, in Comparative Example 1, the amount of P exceeded 5 ppm, and the elongation was low.

In Comparative Examples 2, 7, and 15, the value of $(A)=Sr-4.2\times P$ was less than 50, and the amount of Cu added was larger than 0.60%. Thus, the target tensile strength was achieved, but the elongation was low.

In Comparative Example 3, the contents of the components were within the same range as those in Examples 1 to 6, except that no Mn was added.

Thus, as the target tensile strength and target elongation were achieved, Comparative Example 3 may be included in Examples of the disclosure from the view point of these results. However, seizure was observed in the product because no Mn was added, Comparative Example 3 was classified into Comparative Examples.

In Comparative Example 4, the elongation was low because of the low value of (A), and seizure to the mold occurred because no Mn was added.

Also in Comparative Examples 5, 6, and 9, the value of (A) was low, and the elongation was low.

In Comparative Example 10, the amounts of Mg and Cu added were relatively large. Thus, the target tensile strength was achieved, but the value of (A) was low, and the elongation was unsatisfactory.

In Comparative Examples 12 and 13, the amount of Cu added was small, and the tensile strength was low.

Comparative Examples 14, 16, 17, 19, and 22 are examples in which the T6 treatment was conducted. Among these, Comparative Examples 16 and 17 achieved the target tensile strength and the target elongation, but they could not achieve the targets by the T5 treatment.

In Comparative Example 20, 21, and 23, it was possible to increase the tensile strength by increasing the amount of Cu added, but the elongation was lowered.

The aluminum alloy for use in die casting can be used in various components from which a high tensile strength and a high elongation are required.

What is claimed is:

1. A functional component having a tensile strength of 260 MPa or more and an elongation of 10% or more, provided by a thermal refining T5 treatment after die casting using an aluminum alloy consisting of, by mass:

7.9 to 9% of Si, 0.30 to 0.60% of Mg, 0.30 to 0.60% of Cu, 0.25% or less of Fe, 0.60% or less of Mn, 0.2% or less of Ti, 120 to 200 ppm of Sr, and 5 ppm or less and greater than 0 of P, with the balance being Al and inevitable impurities, and wherein $Sr(ppm)-4.2\times P(ppm)\geq 99$.

2. The functional component according to claim 1, wherein the aluminum alloy comprises 144 to 200 ppm of Sr, and $Sr(ppm)-4.2\times P(ppm)\geq 123$.

3. The functional component according to claim 1, wherein the aluminum alloy comprises 0.08 to 0.25% of Fe and 0.20 to 0.60% of Mn.

4. The functional component according to claim 2, wherein the aluminum alloy comprises 0.08 to 0.25% of Fe and 0.20 to 0.60% of Mn.

* * * * *